US008666085B2

(12) United States Patent
Donaldson et al.

(10) Patent No.: US 8,666,085 B2
(45) Date of Patent: Mar. 4, 2014

(54) COMPONENT FOR NOISE REDUCING EARPHONE

(75) Inventors: Mark Donaldson, Auckland (NZ); Andre Steyn, Auckland (NZ); Pierre Victor Manuel Guiu, Auckland (NZ); Damien Oliver Givernet, Auckland (NZ); William James Sim, Auckland (NZ)

(73) Assignee: Phitek Systems Limited, Auckland (NZ)

( * ) Notice: Subject to any disclaimer, the term of this patent is extended or adjusted under 35 U.S.C. 154(b) by 607 days.

(21) Appl. No.: 12/286,824

(22) Filed: Oct. 2, 2008

(65) Prior Publication Data

US 2009/0161885 A1 Jun. 25, 2009

Related U.S. Application Data

(60) Provisional application No. 60/997,345, filed on Oct. 2, 2007, provisional application No. 61/000,974, filed on Oct. 30, 2007.

(51) Int. Cl.
*H04R 25/00* (2006.01)

(52) U.S. Cl.
USPC ..... 381/71.6; 381/71.7; 381/380; 181/129; 181/130

(58) Field of Classification Search
USPC ..... 381/71.6, 71.7, 329, 370, 380; 181/129, 181/130
See application file for complete search history.

(56) References Cited

U.S. PATENT DOCUMENTS

| | | | |
|---|---|---|---|
| 1,368,307 | A | 2/1921 | Waldron |
| 1,498,727 | A | 6/1924 | Haskel |
| 1,514,152 | A | 11/1924 | Gernsback |
| 1,586,140 | A | 5/1926 | Bonnette |
| 1,807,225 | A | 5/1931 | Pack |
| 2,346,395 | A | 4/1944 | Rettinger |
| 2,379,891 | A | 7/1945 | Eckardt |
| 2,427,844 | A | 9/1947 | Eklov |
| 2,490,466 | A | 12/1949 | Olson |
| 2,603,724 | A | 7/1952 | Kettler |
| 2,622,159 | A | 12/1952 | Herman |
| 2,714,134 | A | 7/1955 | Touger |
| 2,761,912 | A | 9/1956 | Touger |
| 2,775,309 | A | 12/1956 | Villchur |
| 2,848,560 | A | 8/1958 | Wiegand |
| 2,972,018 | A | 2/1961 | Hawley et al. |
| 2,989,598 | A | 6/1961 | Touger |

(Continued)

FOREIGN PATENT DOCUMENTS

| | | |
|---|---|---|
| CN | 1101203 | 4/1995 |
| CN | 1213626 | 4/1999 |

(Continued)

*Primary Examiner* — Jeremy Luks
(74) *Attorney, Agent, or Firm* — Jackson Walker, LLP

(57) ABSTRACT

An active noise reduction (ANR) component for provision in an earphone housing is disclosed. The device includes a driver and a sensing microphone, the driver and sensing microphone being housed in a component housing. The earphone housing has an outlet passageway from the ANR component to an auditory canal. The ANR component is adapted for use with a controller to provide active noise reduction to the auditory canal over a predetermined range of physical dimensions or acoustic parameters of the housing outlet passageway. The ANR component can thus be used with different housings which simplifies the design process for producing ANR earphone products.

8 Claims, 10 Drawing Sheets

(56) References Cited

U.S. PATENT DOCUMENTS

| | | | | |
|---|---|---|---|---|
| 3,073,411 | A | 1/1963 | Bleazey | |
| 3,112,005 | A | 11/1963 | Shaw | |
| RE26,030 | E | 5/1966 | Marchand | |
| 3,367,040 | A | 2/1968 | Vani | |
| 3,403,235 | A | 9/1968 | Bishop | |
| 3,532,837 | A | 10/1970 | Dyar | |
| 3,602,329 | A | 8/1971 | Bauer et al. | |
| 3,644,939 | A | 2/1972 | Beguin | |
| 3,727,004 | A | 4/1973 | Bose | |
| 3,766,332 | A | 10/1973 | Carlson | |
| 3,927,262 | A | 12/1975 | Goeckel | |
| 3,997,739 | A | 12/1976 | Kishikawa | |
| 4,005,267 | A | 1/1977 | Gorike | |
| 4,005,278 | A | 1/1977 | Gorike | |
| 4,006,318 | A | 2/1977 | Sebesta | |
| 4,027,117 | A | 5/1977 | Nakamura | |
| 4,041,256 | A | 8/1977 | Ohta | |
| 4,058,688 | A | 11/1977 | Nishimura | |
| 4,071,717 | A * | 1/1978 | Fidi et al. | 381/372 |
| 4,156,118 | A | 5/1979 | Hargrave | |
| 4,158,753 | A | 6/1979 | Gorike | |
| 4,211,898 | A | 7/1980 | Atoji et al. | |
| 4,297,537 | A | 10/1981 | Babb | |
| 4,338,489 | A | 7/1982 | Gorike | |
| 4,347,405 | A | 8/1982 | Davis | |
| 4,399,334 | A | 8/1983 | Kakiuchi et al. | |
| 4,403,120 | A | 9/1983 | Yoshimi | |
| 4,418,248 | A | 11/1983 | Mathis | |
| 4,441,576 | A | 4/1984 | Allen | |
| 4,455,675 | A | 6/1984 | Bose | |
| 4,494,074 | A | 1/1985 | Bose | |
| 4,527,282 | A | 7/1985 | Chaplin et al. | |
| 4,528,689 | A | 7/1985 | Katz | |
| 4,529,058 | A | 7/1985 | Emery | |
| 4,572,324 | A | 2/1986 | Fidi et al. | |
| 4,581,496 | A | 4/1986 | Sweany | |
| 4,592,366 | A | 6/1986 | Sainomoto | |
| 4,644,581 | A | 2/1987 | Sapiejewski | |
| 4,646,872 | A | 3/1987 | Kamon | |
| 4,669,129 | A | 6/1987 | Chance | |
| 4,670,733 | A | 6/1987 | Bell | |
| 4,742,887 | A | 5/1988 | Yamagishi | |
| 4,809,811 | A | 3/1989 | Gorike | |
| 4,847,908 | A | 7/1989 | Kieuwendijk | |
| 4,852,177 | A | 7/1989 | Ambrose | |
| 4,893,695 | A | 1/1990 | Tamura et al. | |
| 4,905,322 | A | 3/1990 | Aileo et al. | |
| 4,922,542 | A | 5/1990 | Sapiejewski | |
| 4,949,806 | A | 8/1990 | Hofer | |
| 4,985,925 | A | 1/1991 | Langberg et al. | |
| 4,989,271 | A | 2/1991 | Sapiejewski | |
| 5,001,763 | A | 3/1991 | Moseley | |
| 5,020,163 | A | 6/1991 | Aileo et al. | |
| 5,117,461 | A | 5/1992 | Moseley | |
| 5,134,659 | A | 7/1992 | Moseley | |
| 5,181,252 | A | 1/1993 | Sapiejewski | |
| 5,182,774 | A | 1/1993 | Bourk | |
| 5,208,868 | A | 5/1993 | Sapiejewski | |
| 5,267,321 | A | 11/1993 | Langberg | |
| 5,305,387 | A | 4/1994 | Sapiejewski | |
| 5,343,523 | A | 8/1994 | Bartlett et al. | |
| 5,497,426 | A | 3/1996 | Jay | |
| 5,504,281 | A | 4/1996 | Whitney | |
| 5,652,799 | A | 7/1997 | Ross et al. | |
| 5,675,658 | A | 10/1997 | Brittain | |
| 5,740,257 | A | 4/1998 | Marcus | |
| 5,909,498 | A * | 6/1999 | Smith | 381/380 |
| 5,913,178 | A | 6/1999 | Olsson | |
| 5,937,070 | A | 8/1999 | Todter et al. | |
| 5,970,160 | A | 10/1999 | Nilsson et al. | |
| 6,061,456 | A | 5/2000 | Andrea et al. | |
| 6,084,976 | A | 7/2000 | Lin | |
| 6,163,615 | A | 12/2000 | Callahan | |
| 6,278,786 | B1 | 8/2001 | McIntosh | |
| 6,532,296 | B1 | 3/2003 | Vaudrey et al. | |
| 6,597,792 | B1 | 7/2003 | Sapiejewski | |
| 6,683,965 | B1 * | 1/2004 | Sapiejewski | 381/380 |
| 6,738,487 | B1 * | 5/2004 | Nageno et al. | 381/322 |
| 6,831,984 | B2 | 12/2004 | Sapiejewski | |
| 7,103,188 | B1 | 9/2006 | Jones | |
| 7,248,705 | B1 | 7/2007 | Mishan | |
| 2002/0015501 | A1 | 2/2002 | Sapiejewski | |
| 2003/0095670 | A1 | 5/2003 | Wurtz | |
| 2003/0202668 | A1 * | 10/2003 | Kao | 381/74 |
| 2004/0017919 | A1 | 1/2004 | Miyakura | |
| 2006/0067555 | A1 | 3/2006 | Tsai | |
| 2006/0098836 | A1 | 5/2006 | Sabick et al. | |
| 2007/0201717 | A1 * | 8/2007 | Dyer et al. | 381/380 |
| 2008/0159554 | A1 | 7/2008 | Sung et al. | |

FOREIGN PATENT DOCUMENTS

| | | | |
|---|---|---|---|
| DE | 3512405 | A1 | 10/1985 |
| DE | 8703084 | | 11/1987 |
| EP | 0195641 | B1 | 9/1986 |
| EP | 0582404 | | 2/1994 |
| EP | 0582404 | A3 | 2/1994 |
| EP | 0414479 | | 9/1995 |
| EP | 0688143 | | 12/1995 |
| EP | 0873040 | | 10/1998 |
| EP | 0688143 | B1 | 8/2001 |
| FR | 2595178 | A1 | 9/1987 |
| GB | 1379372 | | 1/1975 |
| GB | 2000941 | | 1/1979 |
| GB | 2168220 | A | 6/1986 |
| GB | 2172470 | A | 9/1986 |
| GB | 2187361 | A | 9/1987 |
| GB | 2188210 | A | 9/1987 |
| GB | 3706481 | C2 | 9/1987 |
| GB | 2234882 | | 2/1991 |
| GB | 2234882 | A | 2/1991 |
| JP | 04227396 | A | 8/1992 |
| NL | 8101815 | | 11/1981 |
| WO | WO91/13429 | | 9/1991 |
| WO | WO 95/00946 | | 1/1995 |
| WO | WO 95/08907 | | 3/1995 |
| WO | WO 98/41974 | | 9/1998 |
| WO | 9905998 | | 2/1999 |
| WO | WO 2007/054807 | | 5/2007 |
| WO | WO 2007054807 | A2 * | 5/2007 |

* cited by examiner

– Typical preferred response (103)
– Bounds (100 lower bound and 101 upper bound)
– Usual ECM's response (102)

COMPONENT FOR NOISE REDUCING EARPHONE

This application claims the benefit of and priority from U.S. Provisional Patent Application Ser. No. 60/997,345, filed Oct. 2, 2007; and U.S. Provisional Patent Application Ser. No. 61/000,974, filed Oct. 30, 2007.

FIELD OF THE INVENTION

The present invention relates to earphones and has particular application to earphone apparatus for active noise control applications. The invention is also generally applicable to the field of active noise control, which is sometimes referred to as active noise cancellation (ANC) or active noise reduction (ANR). For convenience, the term ANR will be used in the remainder of this document to refer to active noise control devices and systems.

BACKGROUND

Headphones such as circum aural or supra aural types which include ANR are well known. In essence, such headsets include a microphone to sense unwanted noise, and a signal representative of the noise is provided to feedback or feedforward controllers, which then provide a control signal to a driver that incorporates a signal out of phase with the undesired noise. Such devices tend to provide good active noise reduction at low frequencies but have difficulty actively reducing higher frequencies. However, when combined with effective passive insulation provided by a closed ear cup, a broad band noise reduction effect can be realized.

Presently, few active noise reduction earphone solutions exist in the marketplace. The few products that have been developed and commercialised almost all rely on a feedforward active noise reduction configuration.

A feedforward active noise reduction system relies on a reference signal to generate a control response, this reference signal being in some manner related to the signal requiring control.

The best choice of reference signal is then a measure of the ambient noise directly outside of the earphone's passive seal against the ear canal. This reference signal, obtained by way of a microphone transducer, is processed by noise reduction electronic circuitry (filters) to generate an appropriate control response. This is then input into the earphone's speaker, or driver. The circuitry is designed to replicate the dynamic behaviour of the acoustic system between the reference measurement and driver position. All things being equal, the control response, once inverted and output via the earphone's driver, will effect reduction of the noise that has infiltrated the ear canal.

A fixed controller, i.e. one whose parameters are fixed, does not have any measure of its own performance. It relies on a priori knowledge of the disturbance (noise) from the reference signal and the acoustic system.

Thus a fixed or non-adaptive control filter designed for one earphone configuration may represent a less than accurate control filter for another. This may ultimately lead to the creation of an inaccurate control response and poor performance—often amplification of noise (constructive interference) at certain frequencies.

Adaptive filters offer the advantage that the model of the transfer function between the measurement position and speaker is developed in real-time, converging on a best fit approach based on a given cost index. However, performance is often limited by the accuracy of the secondary path model, which again may only be accurate for a single incarnation of the product. Furthermore, adaptive filters often realise poor model accuracy at lower frequencies, where the dynamics of the system maybe of low sensitivity, but where maximum noise cancellation is desired.

A feedback or regulated control configuration alters the control response based on an error signal measured at a position downstream from the driver. This error signal represents the difference between the desired outcome and the measured result. The filtering of the error signal can tailor the performance of the system to provide deep levels of noise cancellation. Since a feedback system is regulated, performance is less sensitive to variations in components and assembly. The increased noise reduction (or depth of noise reduction) available with feedback systems, especially at low frequencies, is a significant advantage over feedforward configurations.

Because connection of the error signal to the control filters creates a feedback loop in the system, the response of a feedback control configuration is susceptible to closed-loop instability. In the context of active noise reduction, instability manifests itself as an uncontrolled ringing. Such a condition is unpleasant and can damage the hearing organ. Instability problems have lead to very few earphones which incorporate active noise reduction systems being successful, commercially viable, consumer products. One such consumer product is described in International Patent Application WO2007/054807 in the name of Phitek Systems Limited and is sold at market as Part No. 2004 ANR Earphone by Phitek Systems Limited. Development of an effective feedback based active noise reduction earphone requires a careful balancing of a number of system parameters.

Engineering an effective and stable feedback-based active noise reduction earphone that provides cancellation over a reasonable bandwidth is a challenging exercise given the limited air volume, low damping and variations commonly experienced in assembling the transducers within a very small acoustic cavity. Placement of the microphone and driver is critical, as is the size and configuration of the acoustic cavity, its venting and damping. To date, the design and manufacture of feedback based active noise reduction earphones has been carefully managed by highly qualified design teams on a product-by-product basis. This makes the design and production process very difficult, time consuming and expensive.

OBJECT

It is an object of the invention to provide an active noise reduction component for provision in an earphone.

Alternatively it is an object of the invention to provide an improved active noise reduction earphone or earphone system, or to provide improved methods of providing or designing noise reduction earphones.

Alternatively it is an object of the invention to provide a useful alternative to known active noise reduction products, or product design processes or systems.

SUMMARY

An ANR component for provision in an earphone housing is disclosed. The device includes a driver and a sensing microphone, the driver and sensing microphone being housed in a component housing.

In some embodiments the ANR component includes a front cavity between the driver membrane and the component housing in front of the driver, and a rear cavity between the driver and the component housing on the side of the driver opposite the front cavity. The rear cavity may in some embodiments include a vent.

In some embodiments the rear cavity includes a damping material which may partially decouple the acoustic load of the earphone housing rear cavity.

In another aspect, the disclosed subject matter encompasses an ANR earphone including an ANR component and an earphone housing, the earphone housing having a housing outlet passageway from an outlet of the ANR component to an auditory canal.

In some embodiments the ANR component is adapted for use with a controller to provide active noise reduction to the auditory canal over a predetermined range of physical dimensions of the housing outlet passageway. In some embodiments the ANR component is adapted for use with a controller to provide active noise reduction to the auditory canal over a predetermined range of an acoustic parameter of the housing outlet passageway.

In still another aspect, the disclosed subject matter encompasses an ANR earphone system including an ANR component and a plurality of earphone housings, one of the earphone housings having a different housing outlet passageway to the other earphone housing(s).

In still another aspect, the disclosed subject matter encompasses a method of providing an ANR earphone. The method includes the steps of providing an ANR component adapted for use with an earphone housing having a housing outlet passageway from an outlet of the ANR component to an auditory canal. The ANR component is adapted for use with a controller to provide active noise reduction to the auditory canal over a predetermined range of physical or acoustic dimensions of the housing outlet passageway.

Further aspects of the invention will become apparent from the following description.

BRIEF DESCRIPTION OF THE DRAWINGS

One or more embodiments will be described below with reference to the accompanying drawings in which.

DETAILED DESCRIPTION OF ONE OR MORE PREFERRED EMBODIMENTS

In one aspect an ANR component that tolerates variations in the earphone housing in which it is located, i.e. an ANR component that can be placed in one of a number of different housing configurations that can be used to provide a number of different ANR earphone products, is disclosed. This allows many different cosmetic designs to be provided. The disclosed device addresses very significant challenges. For example, an ANR component that can be housed in such a manner may be small so as to be ergonomically viable. It might also be self-contained and robust. The size constraints mean that a thin-walled construction is desirable, but thin walls place severe constraints on internal support structures meaning that the baffle structures and seals used in traditional ANR designs cannot be accommodated. For example, using a metallic housing severely limits the creation of internal support profiles for mounting components. Furthermore, the acoustic properties of such a device must be controlled so as to be compatible with the majority of earphone formats and form factors.

One or more embodiments described below provide an ANR component in the form of a self-contained, skinnable, ergonomically compatible capsule having acoustic properties that can be controlled by application of specific housing conditions which are compatible with most earphone formats and form factors.

Figure 1:
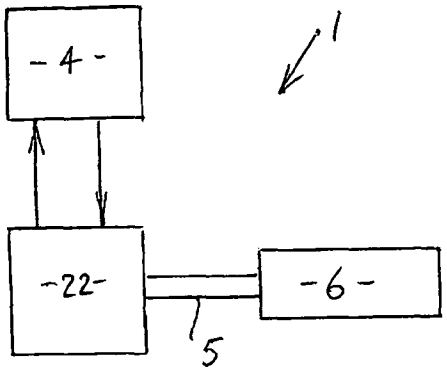
FIG. 1 is a diagrammatic outline of selected elements of an embodiment of an active noise reduction system.

Referring to FIG. 1, a block diagram illustrates selected elements of an embodiment of an active noise reduction system 1. The depicted embodiment of system 1 includes an ANR earphone or headphone component 22 that supports a driver and a sensing microphone (not depicted). A controller 4 includes control circuitry for receiving noise signals from the sensing microphone and providing an appropriate electric signal to the driver for effective noise reduction. ANR component provides ANR to an auditory canal 6 via an outlet passageway 5 provided in an earphone housing (not depicted) in which ANR component 22 is located.

Optionally, the controller 4 may receive an audio signal feed so that the user may listen to the signal feed, for example music, while active noise reduction is being effected. In practical embodiments the controller 4 may be included in the earphone housing, or provided remotely, as a medallion for example. Controller 4 may also be provided in other remote apparatus, for example a portable music device such as an MP3 player, or in the armrest of an aircraft seat.

In some embodiments the disclosed apparatae use a feedback noise reduction configuration such as that disclosed in WO2007/054807, which is incorporated herein by reference. However those skilled in the art will appreciate that feedforward configurations, or hybrid control methods could also be used.

Figure 2C:
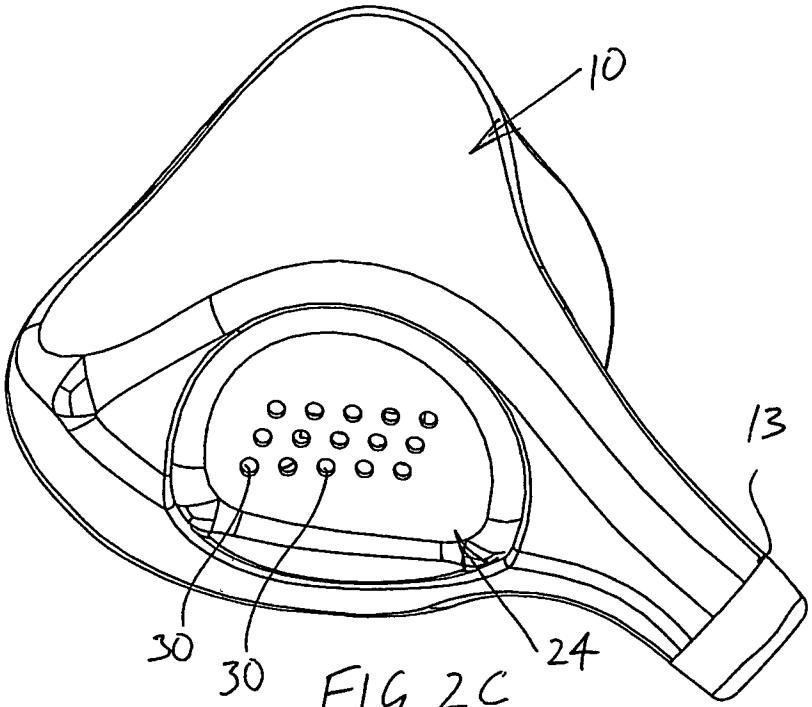
FIGS. 2B and 2C are isometric views of the earphone of FIG. 2 from different angles.
Figure 2B:
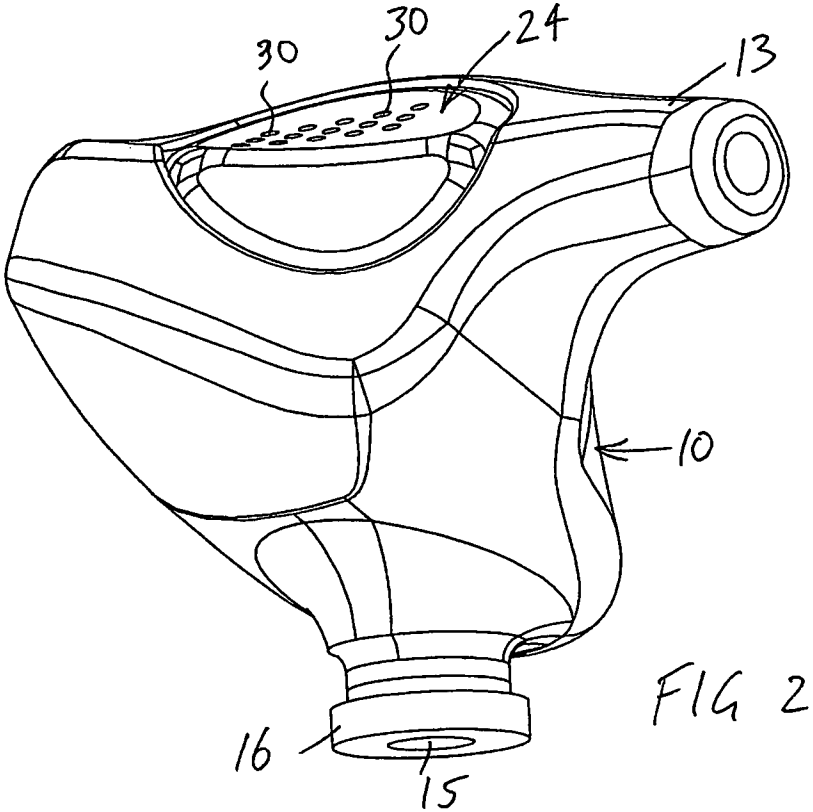
Figure 2A:
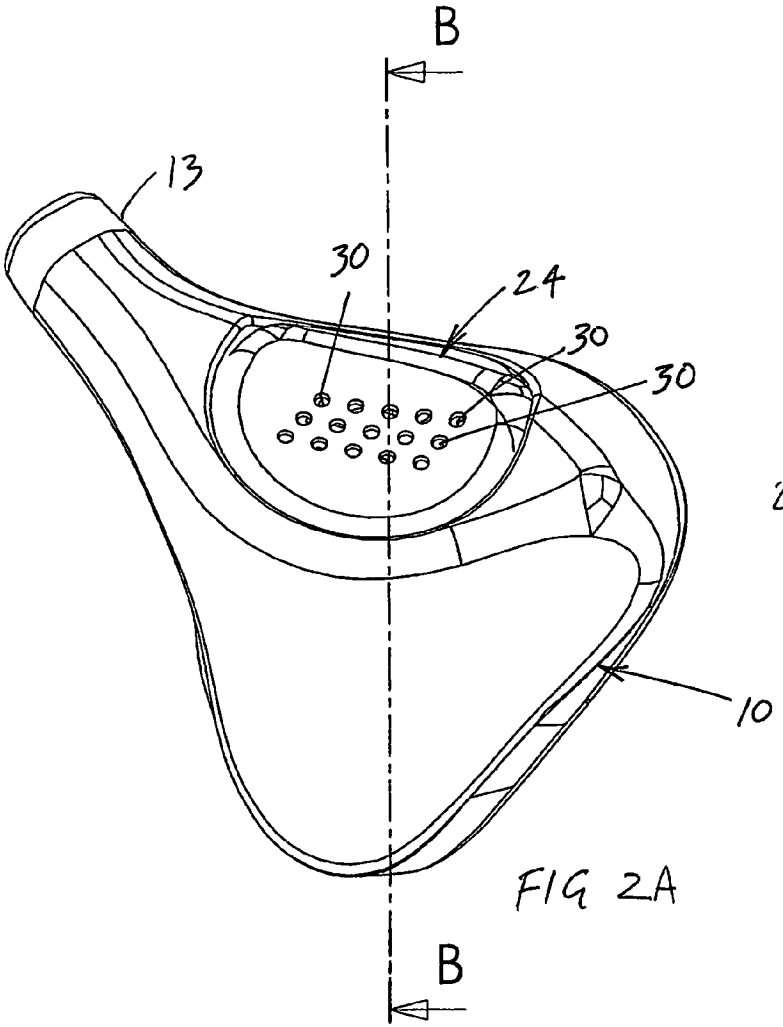
FIG. 2A is a rear elevation of an embodiment of an ANR earphone.

An embodiment of an earphone is illustrated in FIGS. 2A, 2B, 2C, 3 and 4. Referring to FIG. 2C, the rear side of the assembled earphone is shown. As depicted in FIGS. 2A-2C, the earphone is an insert earphone and includes a housing 10 with a rear cap 24 that includes one or more rear acoustic venting apertures 30. It will be appreciated that only one embodiment of housing 10 is shown, but that a wide variety of different housing shapes and formats may be provided.

Figure 3:
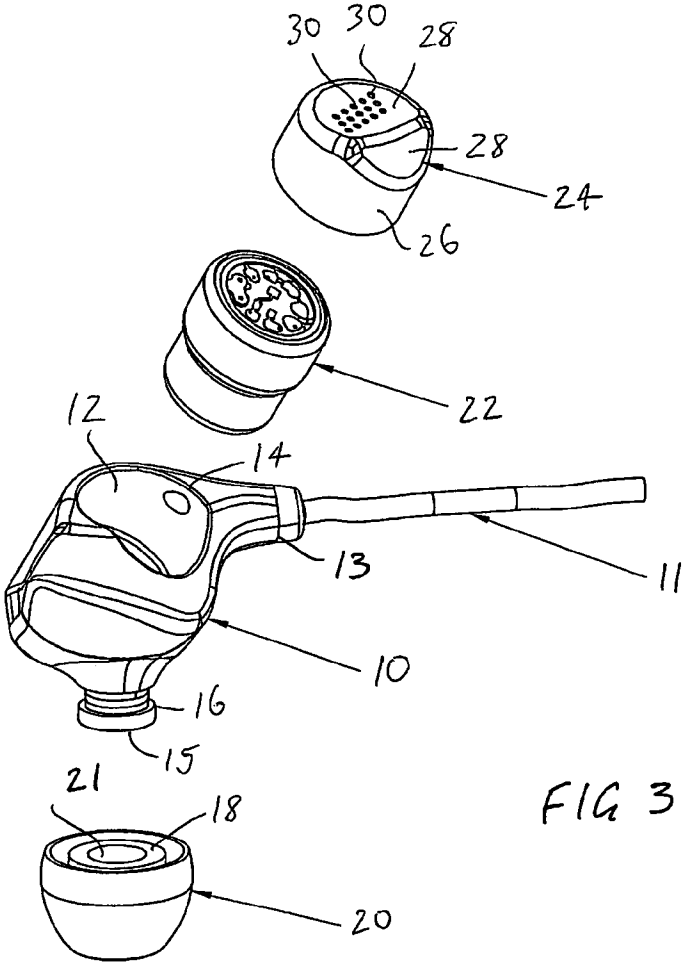
FIG. 3 is an exploded view of the earphone of FIG. 2A.

Turning to FIG. 3, an embodiment of earphone 6 is shown in an exploded view. The earphone housing 10 defines a shaped cavity 12 having an opening 14 at one end and an opening 15 at the other end. Housing 10 may take a plurality of different shapes, but, in the embodiment shown, is shaped to fit within the concha of a human ear. The region of housing 10 surrounding a mouth of opening 15 includes a lip 16, which is adapted to engage with an inwardly protruding annular ring 18 provided on earseal 20. As the earseal 20 is constructed from an elastic or resilient material such as silicon rubber, protrusion 18 can be stretched or otherwise manipulated over lip 16 so as to fasten the earseal 20 to the housing. Earseal 20 defines a central aperture 21 that extends through the body of the earseal 20. Earseal 20 is adapted to make a seal with the entrance to the auditory canal 6.

Figure 4:
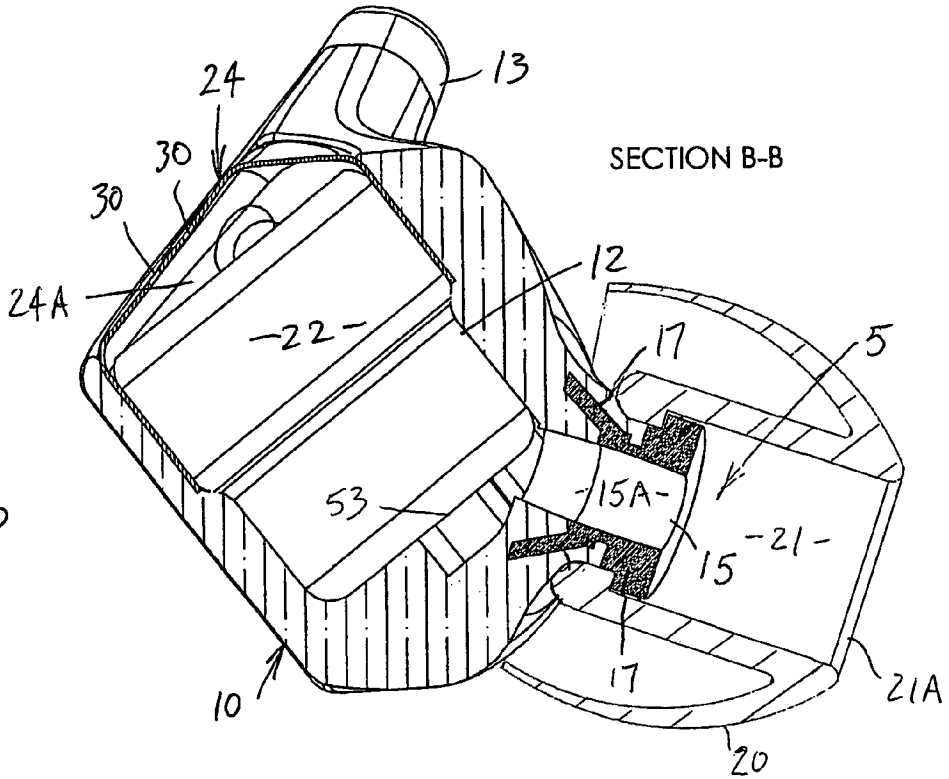
FIG. 4 is a cross section through line BB of FIG. 2A.

Referring to FIG. 4, the embodiment of FIG. 2A is shown in cross-section. In the depicted implementation, a pipe 15A is located at the lower part of cavity 12. Pipe 15A and central aperture 21 of earseal 20 together provide a housing outlet passage generally referenced 5, between an outlet 53 of an ANR component 22 (described further below) and an outlet 21A of the earphone. In the embodiment shown in FIG. 3, the housing 10 has a cable support 13, which supports a wire or cable connection 11 to allow the ANR component 22 to be electrically connected to a controller such as controller 4 of FIG. 1.

As depicted in FIGS. 3 and 4, cavity 12 in earphone housing 10 is adapted to receive ANR component 22. Once the ANR component 22 is located within cavity 12, a cap 24 may be inserted into cavity 12 such that wall 26 of cap 24 is interposed between walls of the cavity 12 and external surfaces of the device 22. In the embodiment shown, an upper surface 28 of cap 24 is configured to conform with the surrounding surfaces of the housing 10. One or more venting apertures 30 are provided in the cap as will be explained further below.

Referring to FIG. 4, a rigid or semi-rigid material 17 may be used to provide the lip 16 and outlet 15. This assists with location and retention of the earseal 20. The material 17 may be formed as a separate component then over-moulded with the remainder of the earphone housing material to provide a resultant and unitary embodiment of housing 10. Earphone housing 10 has a housing rear cavity 24A between the housing structure and the ANR component 22.

Figure 5:
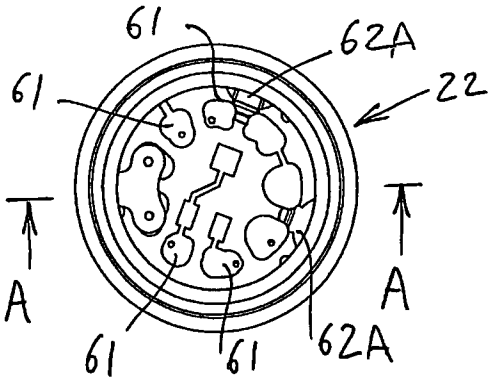
FIG. 5 is a plan view of an embodiment of an ANR component in the form of a capsule.

An embodiment of ANR component 22 will now be described with reference to FIGS. 5, 6 and 7.

The depicted embodiment of ANR component 22 includes a driver assembly 33, a microphone support structure 32 and a microphone 34. ANR component 22 as shown further includes an electrical connector 36 provided between microphone 34 and driver assembly 33, an inner housing part 38, and a main outer housing 40.

Driver assembly 33 includes a driver 31 and a printed circuit board assembly (PCBA) 42. Driver 31 is operably mounted on a front side of PCBA 42. The electrical connector 36 is a flexible printed circuit board (PCB) in one embodiment, and is electrically connected at one end to microphone 34 and, at the other end, to PCBA 42. PCBA provides a medium for allowing electrical connections to be made with cables from external apparatus such as a controller and/or power supply (not depicted). The connections to cables can be conveniently made at connection points 61 provided at a rear side of the PCBA 42. PCBA 42 is provided at a rear end of the housing 40 in the embodiment illustrated and may thus provide a rear wall of the housing 40 when driver 31 is disposed within housing 40. Venting apertures 62 are also provided in the PCBA 40 or rear wall of housing 40, as will be explained further below.

There is a difficulty in making the electrical connection between the microphone and the controller, since the connection must pass the seal between the front and rear cavities. The seal member 44 of the present invention allows the connector 36 to traverse seal member 44 adjacent to an inner wall 41 of housing 40 while still maintaining an effective seal. Alternatively, connector 36 can be arranged so that it routes inside microphone support structure 32 (described further below), passes over sealing member 44 between driver 31 and sealing member 44, then traverses an external wall of driver 31 to connect to PCBA 42.

In one embodiment driver 31 has a typical diameter of 9 mm to 13 mm, but those skilled in the art will appreciate that a variety of different driver shapes and sizes can be accommodated. The diameter of driver 31 used according to one embodiment of the present invention is typically 9.1 mm. Driver diameters over 13 mm are possible, but are not preferred because they become too large for the human ear. A variety of driver technologies exist and may be used, for example balanced armature drivers, electrostatic drivers, or piezoelectric drivers.

Figure 7:
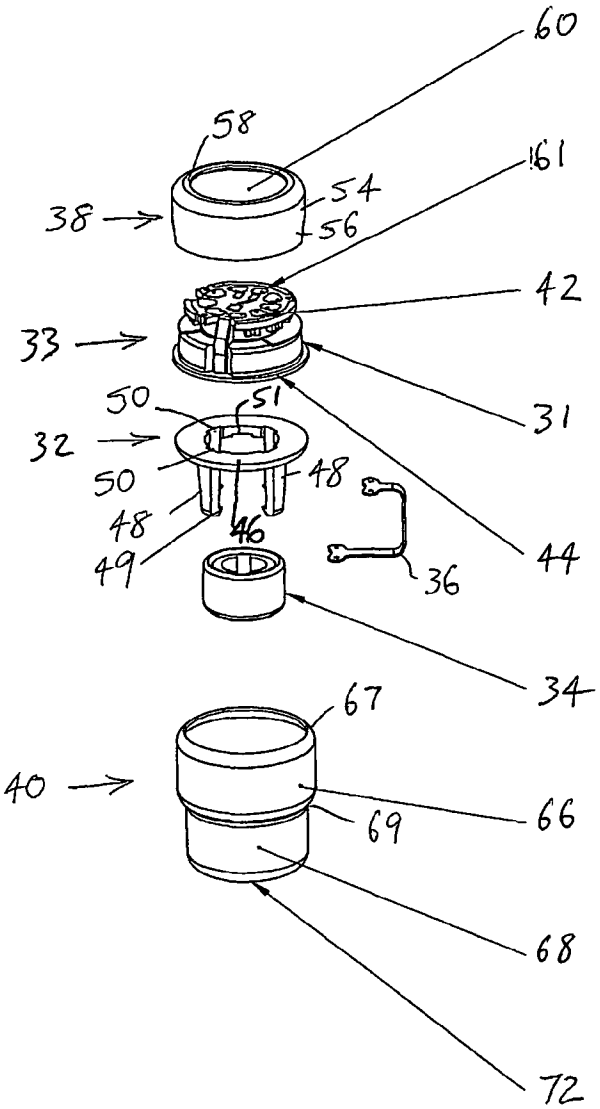
FIG. 7 is an exploded isometric view of the ANR component shown in FIGS. 5 and 6.
Figure 6:
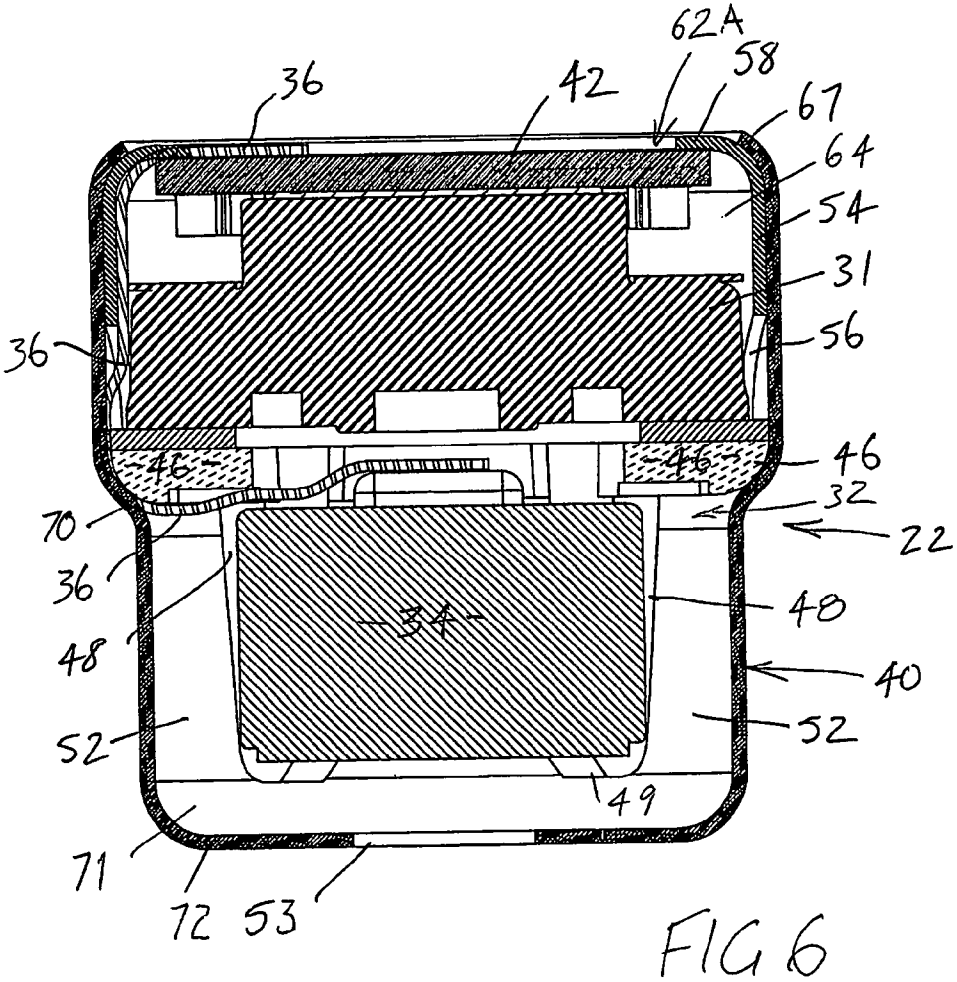
FIG. 6 is a side elevation in cross section AA of FIG. 5.

With continued reference to the embodiment depicted in FIGS. 6 and 7, a sealing member 44 is provided at an outer front edge of the driver 31. In one embodiment, sealing member 44 comprises a gasket. Mounted over the sealing member 44 is a flange 46 of the microphone support structure 32. As can be seen most clearly in FIG. 7, outer peripheral edge of the seal 44 extends slightly beyond (for example approximately 0.5 mm beyond) the outer peripheral edge of flange 46 to thereby make an interference contact with inner wall 41 of housing 40. The sealing member 44 thus acts as both a gasket and an O-ring, i.e. sealing member 44 provides a seal between flange 46 and driver 31, and provides a seal between flange 46 (or driver 31) and inner wall 41

The microphone support structure 32 includes four fingers 48 which project perpendicularly from flange 46, each finger having inwardly directed projections 49 which in use engage with outer surfaces of the microphone 34 to securely engage microphone 34, as shown in FIG. 6. Although four fingers 48 are shown in the described embodiment, this number can vary. The microphone support structure 32 may comprise part of the driver 31. It will also be seen that a recess 50 is defined in an interior diameter of flange 46 at the base of each finger 48. Recesses 51 are also provided in the frame between fingers 48. Recesses 50 and 51 ensure that an acoustic path is present from the front of driver 31 through the support structure 32 and past the microphone 34 into a front cavity 52 of the ANR component 22. Microphone 34 may face toward, or away from, driver 31. The driver 31 and microphone 34 may be provided on a single chassis. Furthermore, microphone 34 may comprise an integral part of driver 31, rather then being a separate component. Those skilled in the art will also appreciate that more than one driver and/or microphone may be used.

Inner housing part 38 includes a circumferential wall 54 that includes a lower skirt portion 56 that is a reduced diameter so as to securely engage with an outer surface of driver 31. An upper, inwardly curved edge 58 defines a rear housing opening 60. The diameter of opening 60 is sufficient to leave recesses 62 (refer to FIGS. 11A-11E and FIGS. 12A-12E) in the printed circuit board assembly 42 exposed to provide one or more rear acoustic openings 62A to vent the rear cavity 64 provided within the ANR component 22 at the rear of the driver.

Component housing 40 includes a first generally cylindrical outer wall 66, a second generally cylindrical outer wall 68 which is a lesser diameter than wall 66, and a transition portion 69 between walls 68 and 66 which provides a shoulder 70. A lower edge of wall 68 curves into a flange portion 72 that includes an acoustic opening defining a front port 53 from the front cavity 52 to the environment external to ANR component 22. The wall portion 66 includes an upper edge 67 which may be swaged over the edge 58 of the inner housing part 38 to secure the assembly.

The seal member 44 provides an acoustic seal between the front cavity 52 and the rear cavity 64. Although other appropriate materials may be used in other embodiments, we have found that a seal member 44 made from a semi-pliable material such as Ethylene-vinyl Acetate (EVA) of a thickness of approximately 0.5 mm is suitable to form an acoustic seal that withstands the expected acoustic pressures present in ANR component 22. In one embodiment, the seal created by seal member 44 between the front and rear cavities prevents any leakage up to a dynamic pressure of at least 1.8 mbar.

As mentioned above, sealing member 44 provides the function of a gasket as it forms a seal with a front peripheral surface of the driver, and also has a protruding peripheral portion which acts as an O-ring to form a seal with inner wall 41 of the ANR component housing 40. Sealing member 44 also allows connector 36 to traverse from the front cavity 52 to the PCBA 42 while maintaining the required seal. The sealing member 44 also allows variations in vertical tolerance of components to be accommodated. For example, tolerance variations in the length of the housing relative to the driver assembly or the support structure 32 can be taken up by the compressible nature of the gasket material from which sealing member 44 is constructed.

Figure 8:
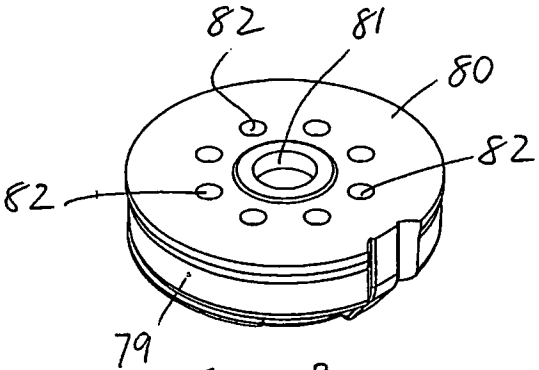
FIG. 8 is an isometric view showing a front side of an embodiment of a driver suitable for use with the ANR component of FIG. 7.
Figure 9:
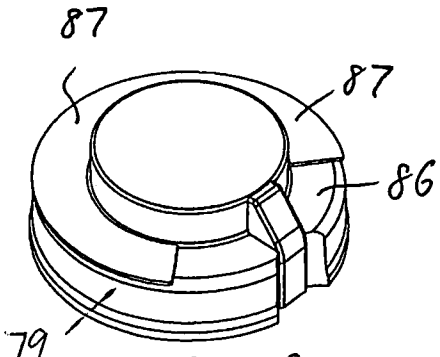
FIG. 9 is an isometric view showing a rear side of the driver of FIG. 8.

The front cavity 52 extends from a front side of the driver, through the support structure apertures 50 or 51 to the front acoustic port 53. Optionally, a material that has an acoustic damping effect such as a filter paper 71 or similar material may be provided in the front cavity 52. Filter paper 71 can prevent ingress of foreign matter into the front cavity as well as providing a damping effect. As described further below, a material such as filter paper 71 can comprise part of the acoustic volume of the front cavity to facilitate damping of high frequency resonant modes of driver 31. Turning now to FIGS. 8 and 9, an embodiment of driver 31 is shown in greater detail. As shown in FIG. 8, driver 31 includes a driver housing 79. Driver housing 79 has a front face 80 with a central opening 81 and a series of smaller surrounding openings 82. Openings 81 and 82 provide an acoustic path from a driver membrane (not shown) to the front cavity. The driver membrane is constructed from a lightweight non-crinkling material, typically Mylar. The driver membrane defines the boundary between the front and rear cavities. Front cavity 52 extends from the driver membrane to outlet 53. Rear cavity 64 extends from the driver membrane to venting aperture(s) 62. Opening 81 may be approximately 2 mm in diameter, and each opening 82 may be approximately 0.9 mm in diameter. The total depth of driver 31 may be approximately 3 mm to 4 mm. A rear face of driver 31 can be seen in FIG. 9. Vents (not shown) are provided in rear housing surface 86, but are covered or at least partially covered by a material that provides acoustic damping. In the embodiment shown the damping material comprises filter paper 87. Driver 31 exhibits consistency of acoustic parameters from one unit to the next. Fastening filter paper 87 to the rear of driver 31 can be difficult to perform in a mass production environment without problematic variation of acoustic parameters. For example, liquid gluing processes have been found to be generally unsatisfactory. However, in one embodiment, the use of adhesive tape such as double sided tape provided between the filter paper 87 and surface 86 has been found to give consistent results. Thus, in one embodiment a partial (or complete) annulus of double sided adhesive tape is provided and the backing layer is removed from one side to affix the tape to the filer paper 87 or to the surface 86. The backing layer from the other side is then removed to attach the tape to the other of the surface 86 or the filter paper 87 to thus provide the construction shown in FIG. 9.

In one embodiment the presence of filter paper 87 provides a fibrous layer which acts to partially enclose the volume of air between the driver membrane or diaphragm and the filter paper 87 to reduce the equivalent volume of the driver suspension. As a result, the acoustic load of rear cavity 24A is decoupled or minimised so to allow a plurality of designs.

Furthermore, filter paper 87 increases the mechanical resistance of driver 31 which serves to damp the fundamental resonance and so equalise the audio response and improve the stability of the closed loop system.

Figure 10:
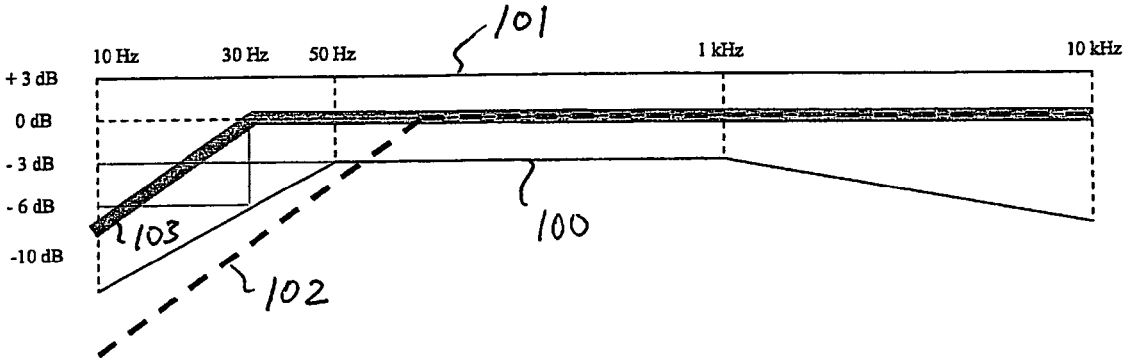
FIG. 10 is a graph of an exemplary frequency response of a microphone used in the ANR component of FIG. 7, FIGS. 11A and 11B are isometric views of an underside and top side respectively of an embodiment of a printed circuit board assembly (PCBA) suitable for use in the ANR component of FIG. 7, FIGS. 11C, 11D and 11E are a plan view from below, side elevation and plan view from above respectively, for the PCBA of FIGS. 11A and 11B, FIGS. 12A and 12B are isometric views of an underside and top side respectively of another embodiment of a PCBA suitable for use in the earphone of the preceding figures.
Figures 11A, 11B, 11C, 11D, 11E:
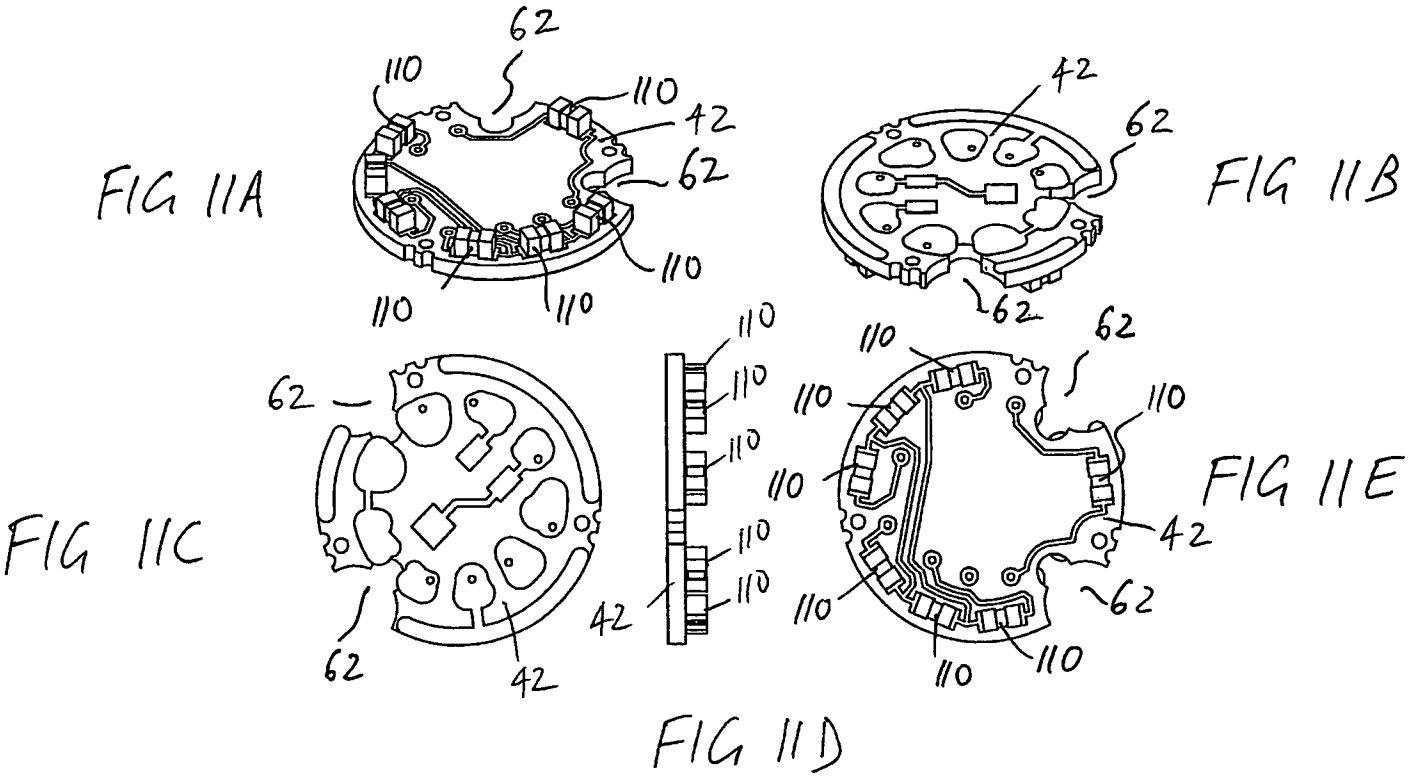
Figures 12A, 12B, 12C, 12D, 12E:
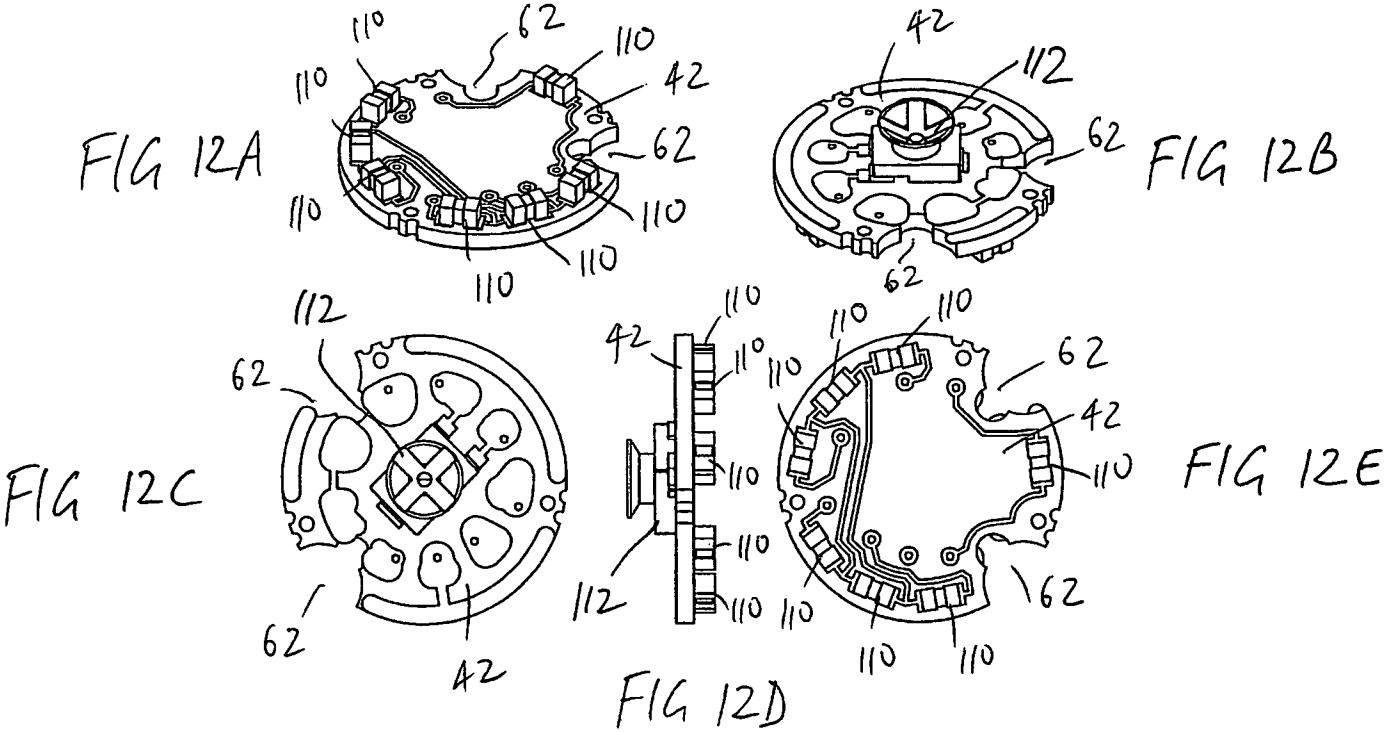
FIGS. 12C, 12D and 12E are a plan view from below, side elevation and plan view from above respectively, for the PCBA of FIGS. 12A and 12B, FIGS. 13A and 13B are plots of an exemplary open loop frequency response for the earphone of FIG. 2A showing the effect on the frequency response of closing the earphone housing rear cavity and providing progressively increased amounts of venting.

Microphone 34 may be implemented with commercially available microphones, for example an Electret Condenser Microphone (ECM). In one embodiment the microphone 34 is an ECM with a sound to noise ratio greater than 65 dB, and has a frequency response with a corner frequency which is less than 30 Hz as shown by line 103 in the frequency response plot of FIG. 10. Referring to FIG. 10, the lines 100 and 101 indicate acceptable limits and broken line 102 indicates the response of a typical ECM. A microphone with a relatively constant sensitivity at frequencies well below 50 Hz does not require additional compensation by the electronic control, typically with a low frequency phase lag filter, in order to prevent oscillation of the closed loop resulting in rumbling.

FIGS. 11A to 11E show the PCBA 42 in greater detail. In particular, the underside of the PCBA 42 can be seen in FIGS. 11A and 11E with filter components 110 being visible. The filter components 110 assist with reduction of radio frequency (RF) interference as is explained further below.

FIGS. 12A to 12E show an embodiment of PCBA 42 that includes an optional trim potentiometer (pot) 112 which allows adjustment of the microphone gain if necessary. The trim pot is part of a microphone bias circuit. Adjustment of the trim pot 112 allows the microphone output gain to be adjusted. Alternatively, in place of trim pot 112, a four resistor tuning method may be used to provide microphone gain adjustment, if required.

PCBA 42, or another PCB in ANR component 22, may include ANR control circuitry so that a separate medallion containing such circuitry is not required. Furthermore, a small battery (not depicted) may be provided in or adjacent to the ANR component 22 (for example, in the earphone housing 10) to provide a power supply.

The housing 10 in one embodiment is constructed from a metallic material such as stainless steel which is relatively easily formed from a sheet material. The metallic housing construction has the advantage that radio frequency interference to the components within the housing is reduced. Furthermore, the PCBA 42 may include a sheet of conductive material (e.g. copper) that extends across at least the majority of the area of the PCBA 42 and which is electrically connected to the housing. In one embodiment the copper sheet is in contact with metallic housing part 38 which is in turn in contact with housing 10 to further shield the internal components from radio frequency interference. Furthermore the filter components 110 together comprise LC low pass filters which are tuned to GSM frequencies which tend to be the most problematic for RF interference. This further reduces RF interference within the housing.

In one embodiment the ANR component 22 may be produced by firstly attaching electrical connector 36 to the microphone 34. The driver assembly 33 including the PCBA 42 is provided and the other end of the connector 36 is attached to the driver 31. The microphone 34 is then attached to the frame 32 by a press fit for example. Sealing member 44 is carefully aligned with the flange 46 of the support structure and connected thereto. The driver 31 is then aligned relative to the sealing member 44 and connected to it. The inner housing part 38 is then located over the driver assembly 31. The module is then press fitted into the main outer housing 40. The protruding peripheral edge of seal 44 contacts the inner wall 41 of outer housing 40 during the fitting operation to thereby form a seal that separates the front and rear cavities. The construction is pressed into outer housing 40 until the outer peripheral edge of the support structure flange 46 abuts shoulder 70 of the housing 40. In this manner, the shoulder 70 allows the position of the driver 31 and microphone 34 to be simply, reliably and predictably located relative to the housing. The lower edges of wall 56 of inner housing part 38 support the protruding edge of sealing member 44 to assist it to make the required seal with the inner wall 41 of outer housing 40. As a final step, the upper edge 67 of the outer housing 40 is swaged over lip 58 of the inner housing part 38 to secure the assembled construction.

The assembled ANR component 22 is then placed in the cavity 12 of the earphone housing 10 such that the front port 53 is acoustically connected to port 15 of the housing as shown in FIG. 4. The cap 24 is then placed over the rear end of the ANR component 22 to complete the earphone assembly. The cavity 12 forms a sufficiently close fit with the outer walls of the outer housing 40 of the ANR component 22 to maintain a sufficient acoustic seal between the front and rear cavities. When used correctly, the earseal 20 also makes contact with internal walls of the ear canal to maintain a sufficient acoustic seal between the front and rear cavities.

Figure 13A:
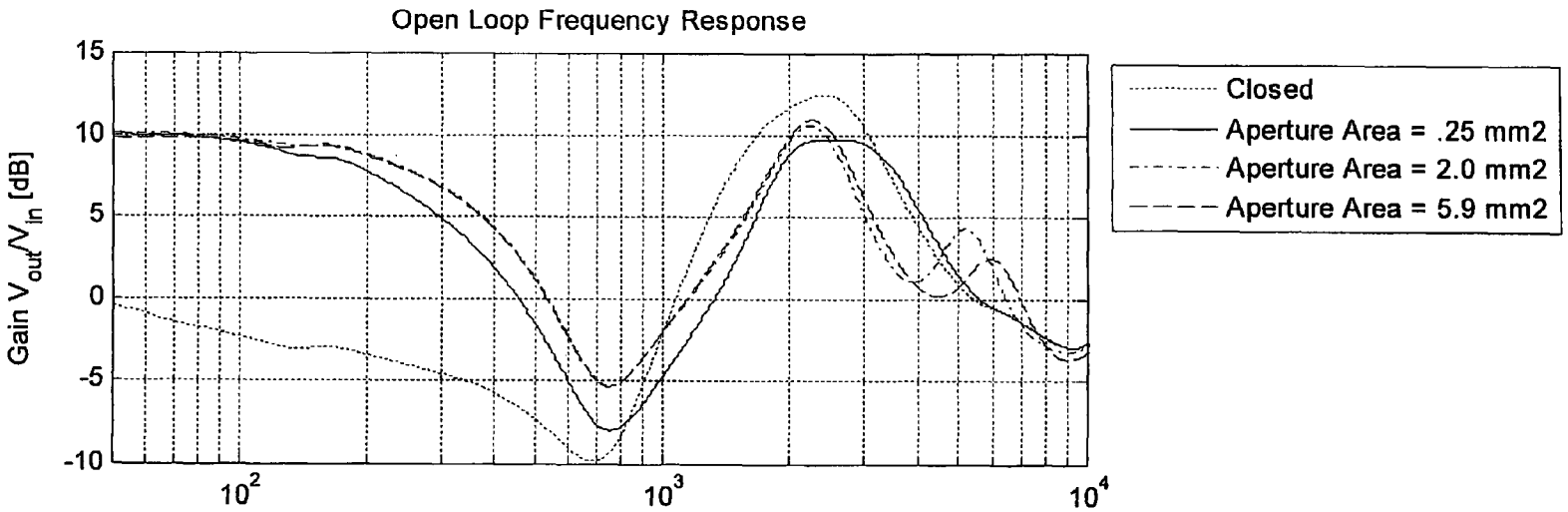
Figure 13B:
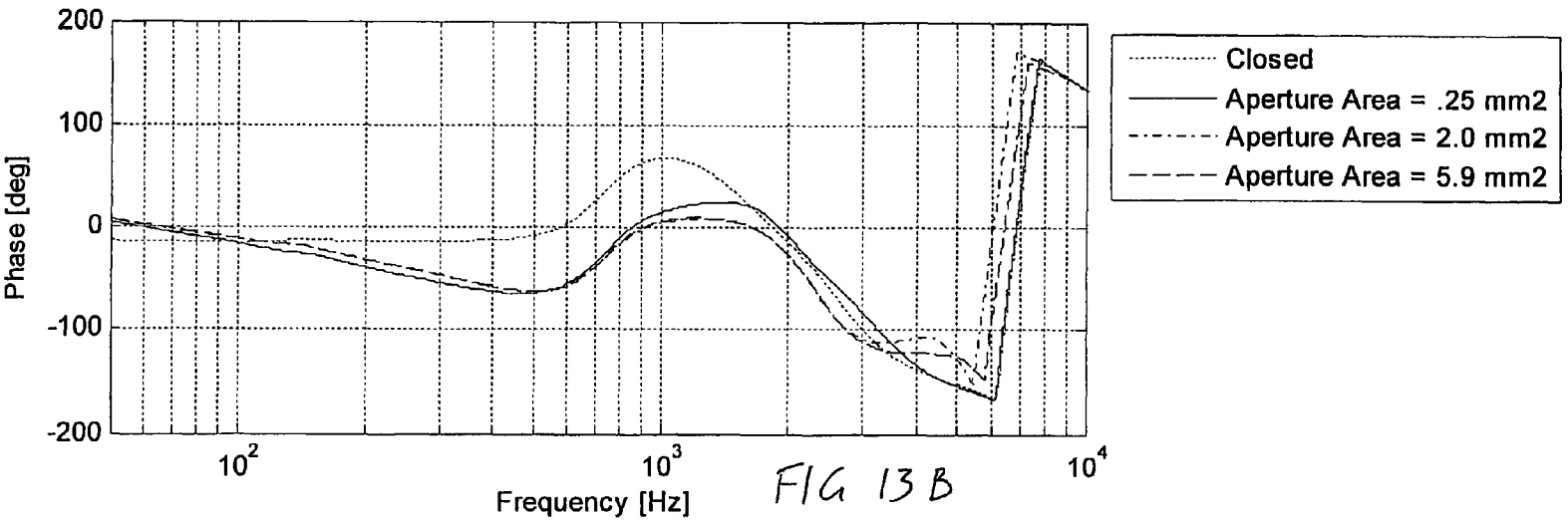

In one embodiment, the volume at the front of the driver 31 is typically greater than 100 $mm^3$ in order to prevent oscillation of the closed loop when the front aperture 53 is blocked, for example while finger manipulating the earphones. However, in one embodiment the earphone housing rear cavity 24A does need to be vented and best results are obtained if the minimum venting aperture area (provided by apertures 30 in the cap 24) is greater than 0.25 $mm^2$. A sufficient venting area is believed to produce linear motion for audio levels up to at least 120 dB(A). Referring to FIGS. 13A and 13B, which show the frequency response relating the driver input voltage ($V_{in}$) and the microphone output voltage ($V_{out}$) (i.e. the driver response as measured by the sensing microphone), it can be seen that closing the rear cavity 24A seriously limits active cancellation performance, whereas gain at low frequencies is significantly improved with venting area over 0.25 $mm^2$.

Figure 14A:
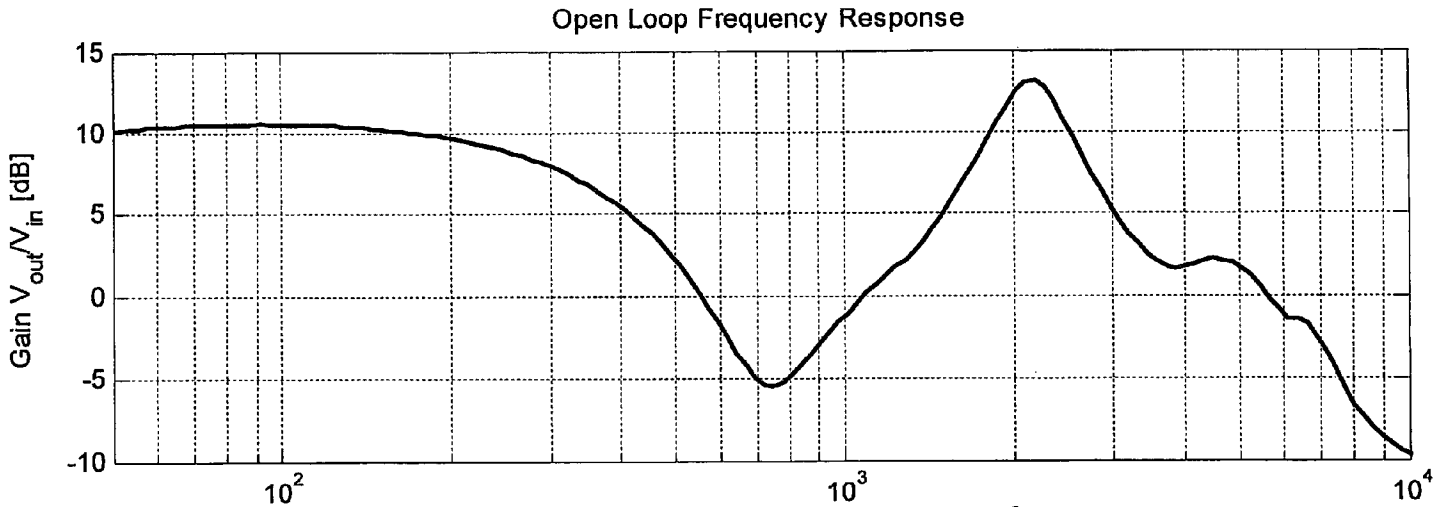
FIGS. 14A and 14B are plots illustrating an exemplary open loop transfer function of the earphone of FIG. 2A.
Figure 14B:
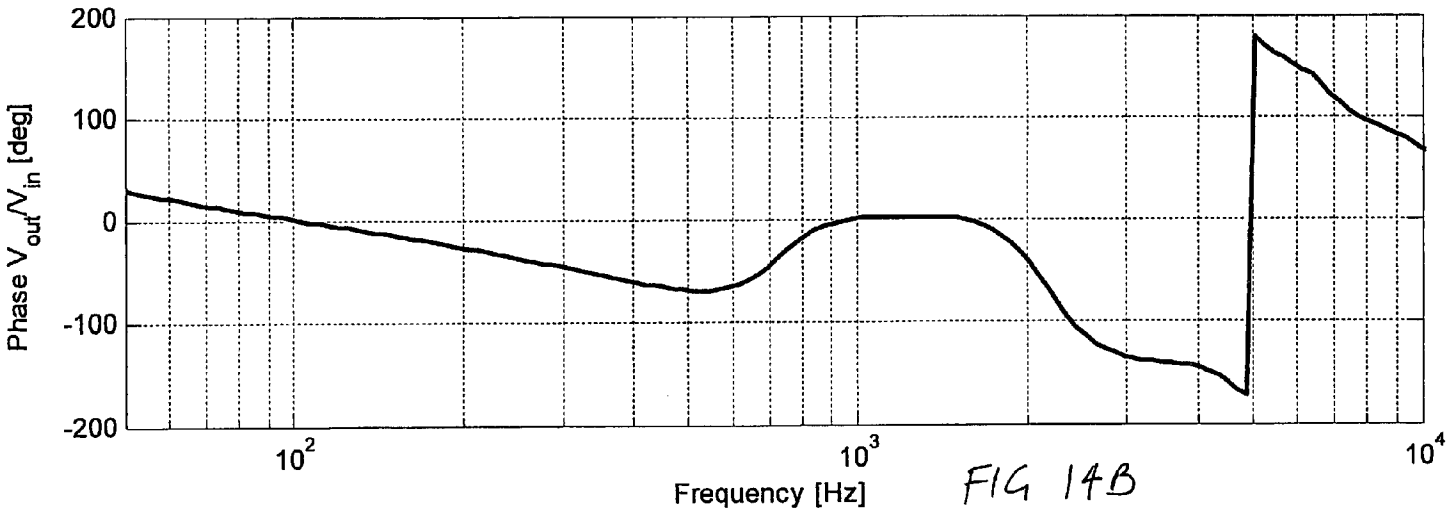

The housing outlet passageway 5 from the front cavity 52 to the ear canal is provided by a pipe 15A and the aperture 21 through earseal 20. As described in WO2007/054807, at audio frequencies of interest for active noise reduction the cavity behaves like a spring of a first given stiffness and the ear canal behaves like a spring of a second given stiffness. The air in the pipe behaves like a mass which experiences damping when it moves in the pipe. This has the effect of a Helmholtz resonator at a predetermined resonant frequency, typically 800 Hz, but the resonant frequency can be varied over a broad range, for example from 500 Hz to 2 kHz, by suitably choosing the dimensions of the outlet 15 and the aperture 21. This is shown in FIGS. 14A and 14B which illustrate the open loop frequency response. The resonant effect is of a second-order lead compensator giving a phase recovery or phase advance which has the effect of advancing the phase of the system in the chosen frequency range. This in turn improves the stability of the system and allows the gain of the controller to be increased without the system becoming unstable. This in turn extends the bandwidth over which noise reduction is effective to improve the closed loop performance of the noise cancellation system. Additional Helmholtz resonators may also be designed into the structure of the ANR component 22 to further shape the acoustic response. For example, in some embodiments the recesses 51 in microphone support structure 32 can be configured to act as acoustic inductive elements between the microphone and the remaining volume of the front cavity, thus creating a Helmholtz resonator. In these embodiments microphone 34 is directed toward the driver 31 i.e. away from outlet 53.

To prevent or minimise the occlusion effect which can occur with use of earphones, a pressure relief vent (not depicted) may be provided. This can be provided in the housing 10, or through the body of ANR component 22. It may also be provided through the driver 31, avoiding over pressurising the driver membrane.

Accordingly there can be an inter-relationship between ANR component 22 and the earphone housing 10. Most significantly, the physical parameters (and thus the acoustic parameters) of the housing outlet passage 5 formed by pipe 15A and central aperture 21 of earseal 20 can be varied. The ANR component 22 has been designed to function with a variety of different pipe lengths and diameters for the housing outlet passage i.e. it will function with pipes having a variety of acoustic impedances and thus allows it to be used with a variety of different earphone housing 10 or "skin" configurations. This means that a complex and expensive ANR design process is not required to provide a variety of different ANR earphones. Instead, all that is required is a relatively simple housing design for each different product and the ANR functionality is provided by the ANR component 22 and its controller. For the disclosed embodiments of ANR component 22 a pipe diameter for the earphone housing 10 exceeding approximately 1.8 mm, and a pipe length for pipe 15A and central aperture 21 to the end of the earseal 20 of approximately 4 mm to 9.8 mm gives the best results. Pipe diameters that are too constrictive increase the velocity of air as it travels from the front volume into the pipe. This increases undesirable high frequency resonances and dynamisms. Therefore, a system designer can develop an ANR earphone by following a "rule based" approach whereby the housing outlet passage is maintained within predetermined parameters. The acoustic property of the housing outlet passage that may be used to determine the design of the ANR component 22 and the controller is the acoustic inductance of the housing outlet passage. The acoustic inductance may vary over a predetermined range, for example 3.8 $kgm^{-4}$ to 5.8 $kgm^{-4}$. Thus the acoustic inductance of proposed designs for the housing outlet passage for housing 10 may be determined empirically or tested to determine those that are appropriate. In some embodiments, the housing outlet passage inductance, when in the required range, provides a resonance to increase the phase at a selected frequency of the open loop transfer function, for example around 500 Hz.

In the embodiment described, the assembled ANR component 22, when connected to or provided with a controller, has all the components necessary to provide ANR. Although the dimensions of the earphone housing 10 may vary (within limits), the critical acoustic parameters of the ANR component are known. Therefore, the ANR component may be placed in a number of different earphone housing constructions and still provide effective ANR without requiring any redesign of the controller. This has the advantage that the single design of ANR component and controller may be used in a number of different earphone or earplug products (or headsets that include earphone-like assemblies). Thus a wide variety of different ANR products can be produced simply and cost effectively.

Therefore, the acoustic parameters of the ANR component 22 are configured such that the device functions in conjunction with a number of earphone housings or skins each of which has a housing outlet acoustic passageway 5 from the device to the auditory canal. Active noise reduction can be performed at, or immediately adjacent to, the eardrum by optimising the controller used with the apparatus. The housing outlet acoustic passageway may have a fixed configuration over a variety of different housing or skin constructions. Alternatively the acoustic delivery path may comprise different materials or dimensions (and thus different acoustic properties) from one earphone housing to another.

The modular nature of the ANR component 22 also means that it can be easily replaced if required (for example if a fault occurs). The invention also allows a manufacturer to provide a consumer with the option of selecting an earphone housing of his or her choice. For example, the consumer can have an ANR insert earphone with a housing that is specifically moulded to his or her ear topology.

The disclosed ANR component 22 allows the condition and elements of the final assembly to be controlled, miniaturized, encapsulated and mass produced reliably to apply effective feedback ANR in an earphone form factor, in a wide range of product formats. This presents the opportunity to transform a complex science managed on a product-by-product basis into a reliable bespoke component that is simply incorporated into an earphone housing or "skin". Those skilled in the art will appreciate that certain principles described in this document will also be applicable to feedforward systems. For example, a feedforward ANR component 22 could be constructed in a housing such as housing 40 with the microphone located behind the driver and through use of an appropriate control device.

Although certain examples and embodiments have been disclosed herein it will be understood that various modifications and additions that are within the scope and spirit of the invention will occur to those skilled in the art to which the invention relates. All such modifications and additions are intended to be included in the scope of the invention as if described specifically herein.

The invention claimed is:

1. A modular ANR component for provision in an earphone housing, the ANR component comprising:

a driver and a sensing microphone, the driver and sensing microphone being housed in a self-contained component housing having an outlet, an acoustic front cavity in the component housing between the driver and the outlet of the component housing, the sensing microphone being provided in the acoustic front cavity, wherein the ANR component is adapted for use with a controller to provide active noise reduction over a predetermined range of acoustic inductance for outlet passageways of earphone housings;

whereby the ANR component is adaptable for use in a plurality of different earphone housing configurations; and wherein the ANR component includes a rear cavity between the driver and the component housing on the side of the driver opposite the acoustic front cavity.

2. The ANR component of claim 1, wherein the rear cavity includes a damping material.

3. The ANR component of claim 2, wherein the damping material reduces the acoustic load of the rear cavity.

4. A modular ANR component for provision in an earphone housing, the ANR component comprising:

a driver and a sensing microphone, the driver and sensing microphone being housed in a self-contained component housing having an outlet, an acoustic front cavity in the component housing between the driver and the outlet of the component housing, the sensing microphone being provided in the acoustic front cavity, whereby the ANR component is adaptable for use in a plurality of different earphone housing configurations;

further including an earphone housing, the earphone housing containing the ANR component and having a housing outlet passageway from the outlet of the ANR component to an outlet of the earphone housing;

wherein the ANR component is adapted for use with a controller to provide active noise reduction to an auditory canal over a predetermined range of acoustic inductance for outlet passageways of earphone housings; and wherein the ANR component includes a rear cavity between the driver and a device housing on the side of the driver opposite to the outlet of the ANR component.

5. The ANR component of claim 4, wherein the rear cavity includes a damping material.

6. The ANR component of claim 5, wherein the damping material reduces the acoustic load of the rear cavity.

7. The ANR component of claim 5, wherein the damping material comprises filter paper.

8. A modular ANR component for provision in an earphone housing, the ANR component comprising:

a driver and a sensing microphone, the driver and sensing microphone being housed in a self-contained component housing having an outlet, an acoustic front cavity in the component housing between the driver and the outlet of the component housing, the sensing microphone being provided in the acoustic front cavity, wherein the ANR component is adapted for use with a controller to provide active noise reduction over a predetermined range of acoustic inductance for outlet passages of earphone housings; and whereby the ANR component is adaptable for use in a plurality of different earphone housing configurations;

wherein the ANR component includes a rear cavity between the driver membrane and the component housing on the side of the driver opposite the acoustic front cavity;

wherein the rear cavity includes a damping material; and wherein the damping material comprises filter paper.

* * * * *